US008876472B2

(12) United States Patent
Dijoud et al.

(10) Patent No.: US 8,876,472 B2
(45) Date of Patent: Nov. 4, 2014

(54) TURBINE WHEEL HAVING DE-TUNED BLADES AND INCLUDING A DAMPER DEVICE

(75) Inventors: Marc Dijoud, Ousse (FR); Jean-Philippe Ousty, Soumoulou (FR)

(73) Assignee: Turbomeca, Bordes (FR)

( * ) Notice: Subject to any disclaimer, the term of this patent is extended or adjusted under 35 U.S.C. 154(b) by 620 days.

(21) Appl. No.: 13/262,512

(22) PCT Filed: Mar. 31, 2010

(86) PCT No.: PCT/FR2010/050604
§ 371 (c)(1),
(2), (4) Date: Sep. 30, 2011

(87) PCT Pub. No.: WO2010/112767
PCT Pub. Date: Oct. 7, 2010

(65) Prior Publication Data

US 2012/0020789 A1 Jan. 26, 2012

(30) Foreign Application Priority Data

Apr. 2, 2009 (FR) ..... 09 52116

(51) Int. Cl.

| | |
|---|---|
| ***F01D 5/14*** | (2006.01) |
| ***F04D 29/38*** | (2006.01) |
| ***F04D 29/34*** | (2006.01) |
| ***F01D 5/22*** | (2006.01) |
| ***F01D 5/16*** | (2006.01) |
| ***F01D 21/04*** | (2006.01) |

(52) U.S. Cl.
CPC *F01D 5/16* (2013.01); *F01D 5/141* (2013.01); *F05D 2220/40* (2013.01); *F01D 5/22* (2013.01); *F01D 21/045* (2013.01); *Y10S 416/50* (2013.01)
USPC ..... 416/2; 416/203; 416/219 R; 416/500

(58) Field of Classification Search
CPC ..... F01D 5/02; F01D 5/021; F01D 5/10; F01D 5/16; F01D 5/3007; F01D 5/3023
USPC ..... 416/203, 219 R, 220 R, 2, 239, 248, 416/204 R, 221
See application file for complete search history.

(56) References Cited

U.S. PATENT DOCUMENTS 2,364,189 A * 12/1944 Buchi ..... 415/117
3,867,069 A 2/1975 Bussell (Continued)

FOREIGN PATENT DOCUMENTS

| | | |
|---|---|---|
| EP | 0 635 623 | 1/1995 |
| EP | 1 698 760 | 9/2006 |

OTHER PUBLICATIONS

Internatioanl Search Report Issued Jul. 3, 2010 in PCT/FR10/050604 filed Mar. 31, 2010.

*Primary Examiner* — Edward Look
*Assistant Examiner* — Michael Sehn
(74) *Attorney, Agent, or Firm* — Oblon, Spivak, McClelland, Maier & Neustadt, L.L.P.

(57) ABSTRACT

A turbine wheel including: a plurality of first and second blades, at least one of the first blades being adjacent to at least one of the second blades; a disk presenting an axis of rotation and a periphery having the blades mounted thereat, each of the blades including a head solid with a root engaged in a housing that opens to the periphery of the disk, each of the blades including a keying mechanism including a respective shelf arranged between the head and the root of the blade, the shelves of the first blades presenting an azimuth length different from the azimuth length of the shelves of the second blades; and a damper device arranged at least between the adjacent blades, the damper device being arranged between the shelves of the blades and the periphery of the disk.

5 Claims, 3 Drawing Sheets

(56) References Cited

U.S. PATENT DOCUMENTS

| | | | | | |
|---|---|---|---|---|---|
| 4,093,399 | A | * | 6/1978 | Glenn | 416/95 |
| 4,101,245 | A | | 7/1978 | Hess et al. | |
| 4,343,594 | A | * | 8/1982 | Perry | 416/193 A |
| 5,435,694 | A | | 7/1995 | Kray et al. | |
| 5,443,365 | A | | 8/1995 | Ingling et al. | |
| 5,474,421 | A | | 12/1995 | Rossmann | |
| 5,593,282 | A | * | 1/1997 | Krueger | 416/219 R |
| 6,004,101 | A | * | 12/1999 | Schilling et al. | 416/224 |
| 6,019,580 | A | * | 2/2000 | Barr et al. | 416/219 R |
| 2004/0219024 | A1 | | 11/2004 | Soupizon et al. | |
| 2005/0249586 | A1 | | 11/2005 | Dupeux et al. | |
| 2006/0193726 | A1 | | 8/2006 | Caruso et al. | |
| 2009/0162205 | A1 | * | 6/2009 | Strangman et al. | 416/219 R |
| 2010/0166561 | A1 | * | 7/2010 | Boyer | 416/219 R |

* cited by examiner

TURBINE WHEEL HAVING DE-TUNED BLADES AND INCLUDING A DAMPER DEVICE

FIELD OF INVENTION

The present invention relates to the field of turbine wheels such as are to be found particularly, but not exclusively, in turbomachines, such as gas turbines. For example, such a wheel may be found in a high pressure turbine or in a free turbine.

BACKGROUND OF THE INVENTION

The present invention relates more particularly to a turbine wheel comprising:

a plurality of blades; and a disk presenting an axis of rotation with the blades mounted at a periphery thereof, each of the blades having a head that is solid with a root that is itself engaged in a housing opening out to the periphery of the disk.

It is well known that when turbine wheels are in operation, in particular within a turbine engine, they are subjected to large variations of vibratory excitation forces.

Under certain circumstances, those vibratory excitations can give rise to high levels of vibration that are harmful and that can lead to the turbine wheel breaking. If the vibratory excitation causes the turbine wheel to enter resonance, i.e. if the frequency of the vibratory excitation corresponds to the resonant frequency of the turbine wheel, and if the resonant deformation mode of the wheel is excitable by the vibratory excitation forces acting on the wheel, then the wheel will present vibration of very large amplitude, subjecting the material of the wheel to mechanical fatigue and in the extreme leading to its destruction.

One technical solution might be to reinforce the mechanical strength of the turbine wheel so that it can withstand vibration better.

Nevertheless, such a solution is not acceptable, in particular when the turbine wheel is for mounting in a turbomachine.

In the design of a turbomachine, the very stringent targets concerning the performance, the fuel consumption, or the mass of the turbomachine, the rotor inertia targets for enabling acceleration to be sufficient, and the targets of complying with reliability requirements or with regulations together impose multiple constraints on the design and sometimes reduce room for maneuver in terms of improving mechanical strength.

By way of example, the technical specifications include a design constraint that the blades must break before the disk breaks in the event of the turbine wheel spinning too fast, in order to limit the energy of any debris, to brake the rotor, and to protect the other elements of the drive train. This situation may occur, for example, in the event of a part of the drive train of the turbomachine breaking, such that a turbine wheel connected to the drive train is no longer subjected to an opposing rotary torque. Under such circumstances, it can be understood that the turbine wheel can then rotate at very high speed, the turbine then being said to be subjected to "overspeed". To avoid the turbine wheel bursting or spinning even faster, which would severely damage the turbomachine, and in order to eliminate the rotary drive torque, the blades are dimensioned so that they break at a given speed of rotation that is slower than the speed at which the turbine wheel would break.

It can thus be understood that the design of a turbine wheel needs to satisfy contradictory targets and that a compromise needs to be found.

By way of example, in order to respond to a problem of vibratory resonance, it is already known to use dampers that are placed between the blades or between the blades and the disk. Nevertheless the use of dampers can be very expensive, since their effect can be verified only very late in the design process, by performing tests on engines. The problem of vibratory resonance remains undiminished if the dampers are not capable of shifting resonance to outside the operating range in which the vibratory excitation is harmful or if the dampers do not enable the amplitude of the vibration to be reduced sufficiently. The outer platforms of the blades or other damper systems may also perform an equivalent function by means of the contacts they establish between adjacent blades.

OBJECTS AND SUMMARY OF THE INVENTION

An object of the present invention is to provide a turbine wheel that presents good tolerance to vibratory excitation while complying without additional difficulty with all of the other design constraints, e.g. including the constraints whereby the blades are dimensioned to break before the disk breaks.

The invention achieves its object by the fact that the turbine wheel of the invention comprises:

a plurality of first blades and a plurality of second blades, at least one of the first blades being adjacent to at least one of the second blades;

a disk presenting an axis of rotation and a periphery having the blades mounted thereat, each of the blades having a head solid with a root engaged in a housing that opens to the periphery of the disk, each of the blades including keying means constituted by a respective shelf arranged between the head and the root of said blade, the shelves of the first blades presenting an azimuth length different from the azimuth length of the shelves of the second blades; and damper device arranged at least between said adjacent blades, said damper device being arranged between the shelves of the blades and the periphery of the disk;

in which turbine wheel the second blades present mass that is less than the mass of the first blades, the mass of the roots of the second blades being less than the mass of the roots of the first blades, while the profiles of the heads of the first and second blades are identical, whereby the resonant frequency of the first blades is different from the resonant frequency of the second blades; and wherein the first and second blades are distributed angularly around the periphery of the disk in such a manner that the center of gravity of the turbine wheel is situated on the axis of rotation of the disk, the second blades differing from the first blades in that the roots of the second blades locally present an azimuth width that is less than the azimuth width of the roots of the first blades, each of the roots of the first and second blades presenting a tang and an attachment member, the head extending radially from the tang while the attachment member is designed to be mounted in the housing, the azimuth width of the tangs of the second blades being less than the azimuth width of the tangs of the first blades, such that the second blades are dimensioned to break before the first blades in the event of the turbine wheel spinning at too great a speed.

The inventors have observed that using at least two types of blades having distinct resonant frequencies serves, most advantageously, to reinforce the effectiveness of the damper device. Insofar as the first blades present a resonant frequency that is different from that of the second blades, the resonances of the turbine wheel are modified with vibratory deformation during resonance presenting amplitudes that are very different between adjacent blades. This effect is referred to as de-tuning.

Furthermore, the inventors have observed that the damper device inserted between adjacent blades and that serves to reduce the amplitude of blade vibration becomes increasingly effective when the relative movements between adjacent blades are large. The greater the improvement in this effectiveness, the more vibratory amplitudes are reduced or the more resonant frequencies are shifted towards other frequencies, and consequently to other operating speeds of the turbine. Under optimum circumstances, this offset serves to reduce the risk of the turbine wheel entering into resonance by shifting the resonant frequencies of the wheel out from the frequency band for harmful vibratory excitation of the wheel. Thus, the invention enables the turbine wheel firstly to be less inclined to enter into resonance and secondly to have vibratory amplitudes that are smaller and that can be accepted by the material of the wheel, which material is then not significantly worn or damaged in fatigue by the vibration.

It is also possible to select blades having different mass distributions.

Preferably, the damper device may be of the friction type. For example, it may be constituted by a plurality of metal plates for inserting under the shelves of adjacent blades. It may also have other forms and it may be positioned elsewhere between the blades. The intensity of the damping may be adjusted by acting on the mass of the plates. The damper device between two adjacent blades may also involve other parts: by way of example the outer platforms of the blades, themselves known, may act as a damper device.

Preferably, the resonant frequency of the first blades is at least 10% greater than the resonant frequency of the second blades.

In preferred manner, the roots of the second blades are weaker than the roots of the first blades.

An advantage of having profiles that are identical is to have a fluid flow that is stable, and also to have a process for obtaining the parts that is simple and inexpensive.

The term "azimuth" is used to mean the direction that together with the axial and radial directions forms an orthogonal frame of reference, it being understood that the axial and radial directions are considered relative to the axis of rotation of the disk.

Each of the roots of the first and second blades presents a shelf, a tang, and an attachment member, with the head extending radially from the tang, while the attachment member is designed to be mounted in the housing and the tang extends from the attachment member to the shelf, the tangs of the second blades presenting an azimuth width that is less than that of the tangs of the first blades. It can thus be understood that the tangs preferably do not contribute to fastening the blades to the disk.

The second blades are preferably obtained from first blades by machining their tangs in such a manner as to reduce their azimuth width.

In order to fasten the blades to the disk, the attachment members preferably, but not necessarily, present a Christmas-tree shape.

Also preferably, the attachment members of the first blades are identical to the attachment members of the second blades, so as to facilitate the machining of the housings in the disk.

Each of the blades includes keying means, in order to avoid the blades being wrongly mounted on the disk. It can be understood that if the blades are not properly mounted on the disk, then the center of gravity of the turbine wheel runs the risk of not being situated on the axis of rotation of the disk, which would give rise to an unbalance of the wheel, thereby giving rise to out-of-balance vibration appearing when it rotates.

The keying means enable the operator who mounts the blades on the disk to avoid making a mistake.

The keying means are in the form of shelves arranged between the heads and the tangs of the corresponding blades, and the shelves of the first blades present a length in the azimuth direction that is different from that of the shelves of the second blades.

Such a shelf is generally present on a turbine blade. It can thus be understood that in the invention use is made advantageously of the shelves as keying means by selecting suitable shapes for the shelves, e.g. their lengths in the azimuth direction.

Another advantage of the shelves is that they can also contribute to providing de-tuning, insofar as the mass of the shelf of a first blade is different from the mass of the shelf of a second blade.

Preferably, but not necessarily, the length of the second shelves in the azimuth direction is greater than that of the first shelves.

Furthermore, the strength of the blades may be freely chosen in such as manner that the first blades or the second blades will break before the disk.

By means of the invention, intentional and programmed breakage occurs in some of the blades only, preferably the second blades, thereby serving to protect the disk from bursting and braking the turbine wheel in the event of overspeed.

Advantageously, the first and second blades are arranged in alternation around the periphery of the disk.

By way of example, it is possible to arrange in alternation a first blade, then a second blade, then a first blade, etc. In another variant, every third blade may be a second blade, providing central symmetry is maintained for the set of second blades. Any other combination is also possible providing the center of gravity of the wheel coincides substantially with the center of the disk.

Without going beyond the ambit of the present invention, it is also possible to provide for the number of blade types to be greater than two.

Finally, the present invention provides a turbomachine including at least one turbine wheel of the invention.

Preferably, but not necessarily, the turbomachine is a helicopter gas turbine and the turbine wheel corresponds to the high pressure turbine wheel and/or to the turbine wheel of the free turbine.

The invention can be better understood and its advantages appear better on reading the following description of an embodiment given by way of non-limiting example. The description refers to the accompanying drawings, in which:

BRIEF DESCRIPTION OF THE DRAWINGS

FIG. 3A is a graph showing the effects of the damping on the vibratory amplitude of the turbine wheel, while

MORE DETAILED DESCRIPTION

Figure 1:
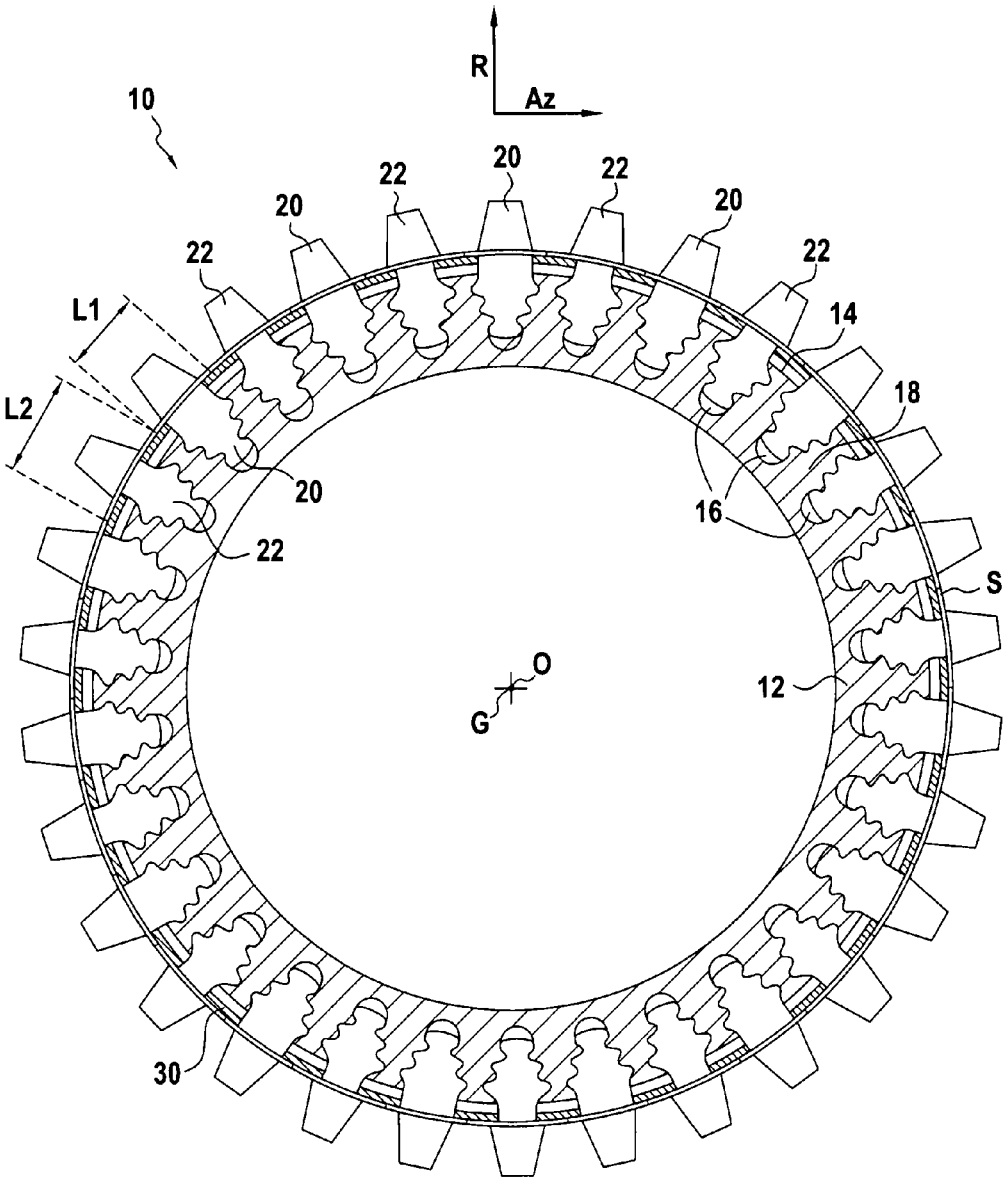
FIG. 1 shows a turbine wheel of the present invention having first and second blades.
Figure 4:
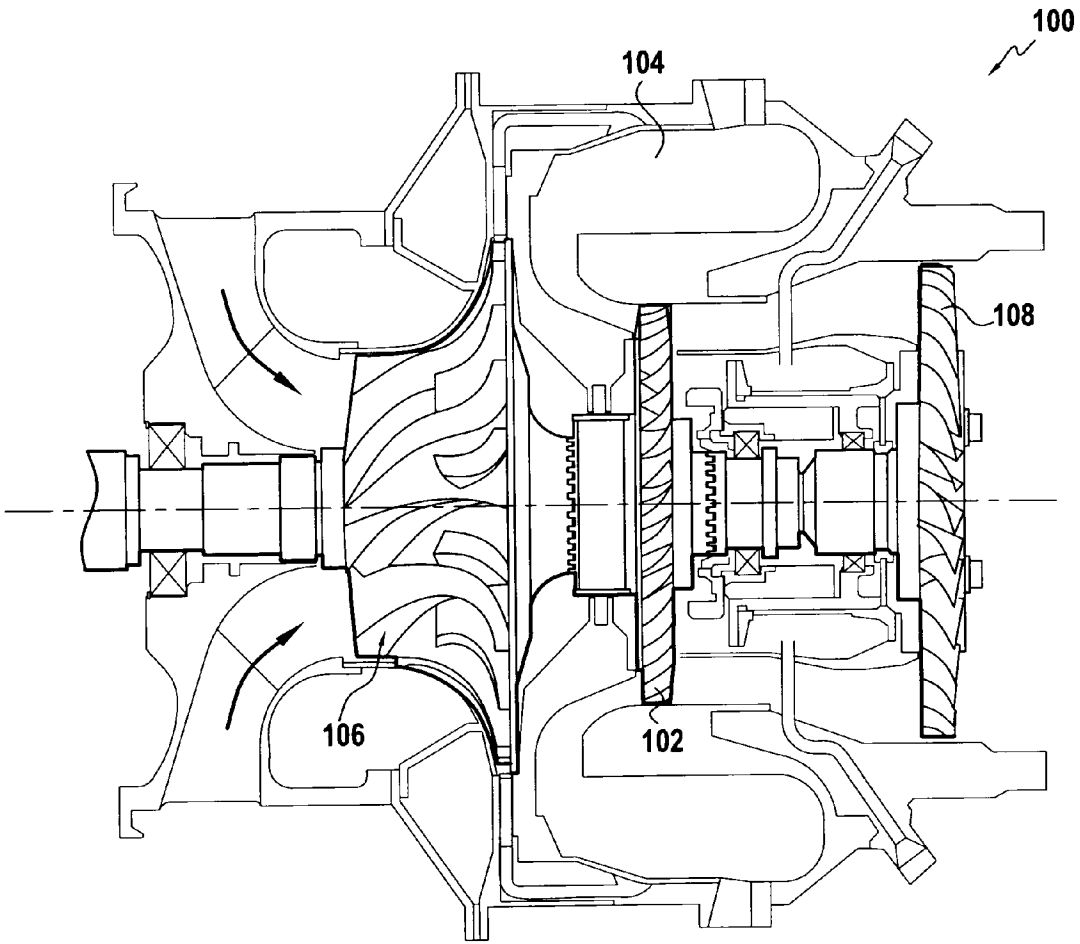
FIG. 4 shows a turbomachine including the turbine wheel of the present invention.

The example of FIG. 1 shows a turbine wheel 10 as usually found in turbomachines such as helicopter gas turbines 100. Conventionally, a gas turbine, such as that shown in FIG. 4, includes a high pressure turbine 102 driven in rotation by a stream of hot gas leaving a combustion chamber 104. The high pressure turbine 102 drives a compressor 106 in rotation in order to compress the fresh air entering into the gas turbine 100 and bring it into the combustion chamber 104 where it is mixed with fuel for combustion purposes.

The excess of the hot gas stream leaving the high pressure turbine 102 is used to drive a free turbine 108 in rotation. This turbine is connected in particular to the main rotor of the helicopter in order to drive it in rotation.

The turbine wheel 10 of the invention may advantageously be used in the high pressure turbine 102 or indeed in the free turbine 108.

With reference once more to FIG. 1, it can be seen that the turbine wheel 10 is made up of a disk 12 having a center O and a periphery 14. The disk 12 is designed to rotate about its axis of rotation that passes through the center O.

In the description below, the terms "axial", "radial", and "azimuth" are used relative to the axis of rotation of the disk. For reasons of clarity, FIG. 1 shows the radial and azimuth directions R and Az for a blade 20.

There can also be seen a plurality of housings 16 formed in the disk 12. More precisely, the housings 16 open out radially into the periphery 14 and extend axially between two opposite faces of the disk 12. As can be seen in FIG. 1, two consecutive housings define a tooth 18.

The turbine wheel 10 also includes a plurality of blades 20, 22, thirty of them in this example, which blades are mounted in the housings 16.

Conventionally, the blades 20, 22 are inserted axially into the housings 16, and they are held axially by an axial retention device that is not shown here.

Each of the blades 20, 22 comprises a head 20*a*, 22*a* that is solid with a root 20*b*, 22*b* that is engaged in its housing 16.

Each of the heads 20*a*, 22*a* presents an aerodynamic profile, itself known, and shown merely in diagrammatic form.

In accordance with the present invention, the profiles of the heads 20*a*, 22*a* are preferably, but not necessarily, identical.

Figure 2:
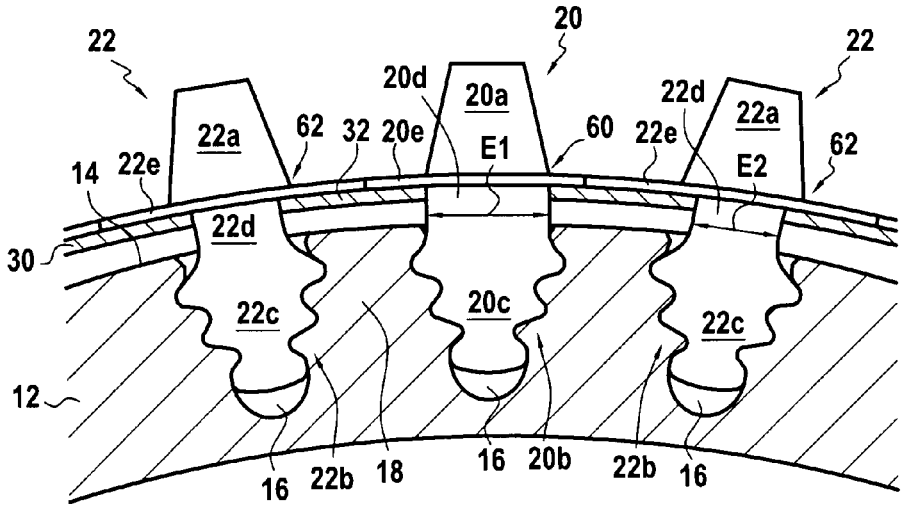
FIG. 2 is a view showing a detail of FIG. 1 comprising a first blade arranged between two second blades for which the azimuth width of the tangs is narrower than that of the tang of the first blade.
Figure 3A:
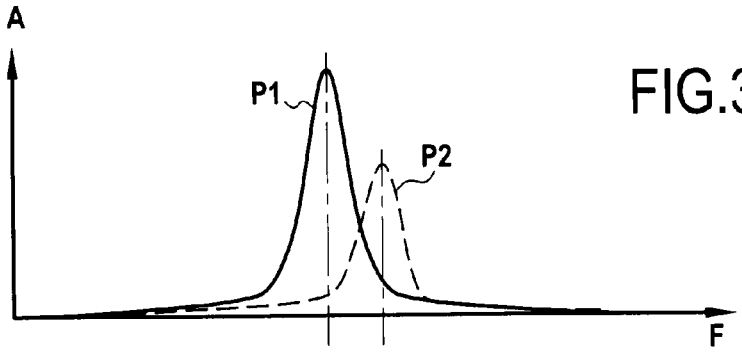
Figure 3B:
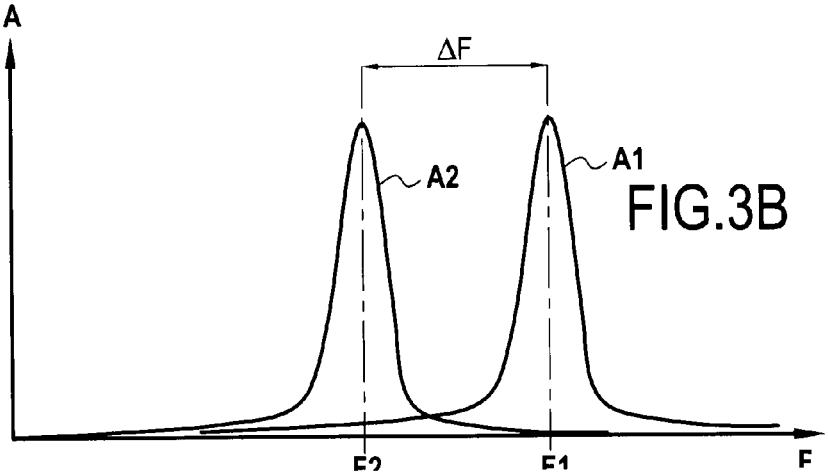
FIG. 3B shows the effects of the de-tuning on the vibratory amplitude of the turbine wheel as a function of the frequency of vibration.

With reference to FIG. 2, it can be seen that each of the roots 20*b*, 22*b* presents an attachment member 20*c*, 22*c* of Christmas-tree shape that co-operates with the edges of the associated housing 16. This particular shape, which is itself already known, serves to hold the blades 20, 22 radially in the disk 12. The attachment members 20*c* of the first blade 20 are preferably identical to the attachment members 22*c* of the second blades 22.

Furthermore, each of the roots 20*b*, 22*b* also presents a tang 20*d*, 22*d* that corresponds to the portion of the root that is situated between the attachment member 20*c*, 22*c* and the head 20*a*, 22*a*. More precisely, in this example, the tang 20*d*, 22*d* is the portion of the root that does not contribute to holding the blade 20, 22 in the housing 16.

In the example shown here, each blade 20, 22 also includes a shelf 20*e*, 22*e* located between the head 20*a*, 22*a* and the root 20*b*, 22*b*, and more precisely between the head 20*a*, 22*a* and the tang 20*d*, 22*d*.

The shelf 20*e*, 22*e* is in the form of a fine plate that extends in a curved surface that is orthogonal to the radial direction R.

As can be seen in FIG. 1, the juxtaposed shelves 20*e*, 22*e* of all of the blades together form an angular surface S that is concentric with the disk 12, with said annular surface S constituting an inner wall for the flow of gas.

In accordance with the present invention, the blades 20, 22 comprise a plurality of first blades 20 and a plurality of second blades 22 that are different from the first blades.

Specifically, the first blades 20 and the second blades 22 are arranged in alternation around the periphery of the disk 14. In this example there are thus fifteen first blades 20 and as many second blades 22.

Furthermore, according to an aspect of the invention, the second blades 22 are of mass that is less than the mass of the first blades 20. In other words, all of the first blades 20 present the same mass, which mass is greater than that of the second blades 22, such that the resonant frequency of the first blades is different from the resonant frequency of the second blades.

Because the first and second blades are arranged in alternation around the disk, it can be understood that the centers of gravity of the set of first blades 20, and of the set of second blades 22 both lie on the axis of rotation of the disk 12, such that the center of gravity G of the wheel 10 is likewise situated on the axis of rotation of the disk, thereby ensuring that the turbine wheel 10 does not present any unbalance in operation.

Advantageously, the roots 22*b* of the second blades 22 are of mass that is less than the mass of the roots 20*b* of the first blades 20, while the profiles of the heads 20*a*, 22*a* of the first and second blades 20, 22 are identical.

For this purpose, and as can be seen in FIG. 2, the second blades 22 differ from the first blades 20 in that the roots 22*b* of the second blades 22 locally present an azimuth width E2 that is less than that of the roots 20*b* of the first blades 20. More precisely, the tangs 22*d* of the second blades 22 present an azimuth width E2 that is less than the azimuth width E1 of the tangs 20*d* of the first blades 20.

In order to obtain a second blade 22, it is thus possible to start with a first blade 20 and to decrease the azimuth width of its tang 20*d* by using machine tools, such as resurfacing cutters. The second blades 22 are thus easy to produce industrially using present production means.

In accordance with the invention, any risk of entering resonance, and the effects that accompany resonance, are further reduced by adding a damper device 30 between the shelves 20*e*, 22*e* and the disk 12.

The damper device 30 is preferably of the friction type. By way of example, it is in the form of metal plates 32 disposed successively beneath the shelves, while also extending between two adjacent blades 20, 22.

As mentioned above, the advantage of having two types of blade of different masses and different stiffnesses serves to obtain blades having resonant frequencies that are different and to de-tune the blades, while the damper system serves to offset the resonant frequency of the turbine wheel so as to avoid the turbine wheel 10 entering into resonance while it is in operation.

In order to avoid the blades 20, 22 being wrongly mounted on the disk 12, which would have the result of offsetting the center of gravity of the wheel 10 in a radial direction and thus of inducing an unbalance that would be harmful for the turbine wheel 10, each of the blades 20, 22 advantageously includes keying means 60, 62.

The keying means 60, 62 are arranged in such a manner that their shapes make it mechanically impossible to mount the blades wrongly, or at least they ensure that wrong mounting is easily detected.

When properly mounted, the azimuth ends of the shelves 20*e*, 22*e* of two adjacent blades are flush so that there is no azimuth gap between two adjacent shelves, other than necessary functional clearance.

As mentioned above, in this example, the blades 20, 22 are advantageously arranged in alternation. In other words, the keying means serve to prevent two first blades 20 (or two second blades 22) being placed one beside another.

For this purpose, the keying means 60, 62 in this example are constituted by the shelves 20*e*, 22*e* of the blades 20, 22. More precisely, the shelves 20*e* of the first blades 20 present an azimuth length L1 that is different from (here shorter than), the azimuth length L2 of the shelves 22*e* of the second blades 22.

It can thus be understood that it is not possible to place two second blades beside each other, insofar as the shelf of one of the second blades prevents the other second blade being inserted axially. Similarly, if the operator inserts two first blades once beside another, the error can be seen immediately since there is then a large azimuth gap between two adjacent shelves.

Furthermore, because the tang of the second blade 22 is fine relative to the tang of the first blade 20, the second blade 22 is advantageously shaped so as to break before the first blade 20 in the event of the turbine wheel spinning at too great a speed.

The invention claimed is:

1. A turbine wheel comprising:

a plurality of first blades and a plurality of second blades, at least one of the first blades being adjacent to at least one of the second blades;

a disk presenting an axis of rotation and a periphery having the blades mounted thereat, each of the blades including a head solid with a root engaged in a housing that opens to the periphery of the disk, each of the blades including keying means including a respective shelf arranged between the head and the root of the blade, the shelves of the first blades presenting an azimuth length different from the azimuth length of the shelves of the second blades; and a damper device arranged at least between the adjacent blades, the damper device being arranged between the shelves of the blades and the periphery of the disk;

wherein the second blades present mass that is less than the mass of the first blades, the mass of the roots of the second blades being less than the mass of the roots of the first blades, while profiles of the heads of the first and second blades are identical, whereby the resonant frequency of the first blades is different from the resonant frequency of the second blades; and wherein the first and second blades are distributed angularly around the periphery of the disk such that the center of gravity of the turbine wheel is situated on the axis of rotation of the disk, the second blades differing from the first blades in that the roots of the second blades locally present an azimuth width that is less than the azimuth width of the roots of the first blades, each of the roots of the first and second blades presenting a tang and an attachment member, the head extending radially from the tang while the attachment member is configured to be mounted in the housing, the azimuth width of the tangs of the second blades being less than the azimuth width of the tangs of the first blades, such that the second blades are dimensioned to break before the first blades in the event of the turbine wheel spinning at too great a speed.

2. A turbine wheel according to claim 1, wherein the attachment members are Christmas-tree shaped.

3. A turbine wheel according to claim 1, wherein the attachment members of the first blades are identical to the attachment members of the second blades.

4. A turbine wheel according to claim 1, wherein the first and second blades are arranged in alternation around the periphery of the disk.

5. A turbomachine including at least one turbine wheel according to claim 1.

* * * * *